US010001715B2

(12) United States Patent
Cho

(10) Patent No.: US 10,001,715 B2
(45) Date of Patent: Jun. 19, 2018

(54) ORGANIC PHOTOSENSITIVE DRUM FOR ELECTRO-PHOTOGRAPHY AND MANUFACTURING METHOD THEREFOR

(71) Applicant: Namhyuk Cho, Chungcheongbuk-do (KR)

(72) Inventor: Namhyuk Cho, Chungju-si (KR)

( * ) Notice: Subject to any disclaimer, the term of this patent is extended or adjusted under 35 U.S.C. 154(b) by 0 days. days.

(21) Appl. No.: 15/110,166

(22) PCT Filed: Jan. 16, 2015

(86) PCT No.: PCT/KR2015/000470
§ 371 (c)(1),
(2) Date: Jul. 7, 2016

(87) PCT Pub. No.: WO2015/108367
PCT Pub. Date: Jul. 23, 2015

(65) Prior Publication Data

US 2016/0327878 A1 Nov. 10, 2016

(30) Foreign Application Priority Data

Jan. 17, 2014 (KR) ..... 10-2014-0005965

(51) Int. Cl.
*G03G 5/00* (2006.01)
*G03G 5/05* (2006.01)
*G03G 5/06* (2006.01)

(52) U.S. Cl.
CPC ..... *G03G 5/0525* (2013.01); *G03G 5/05* (2013.01); *G03G 5/06* (2013.01); *G03G 2215/00957* (2013.01)

(58) Field of Classification Search
None
See application file for complete search history.

(56) References Cited

U.S. PATENT DOCUMENTS 4,680,246 A * 7/1987 Aoki ..... B05C 3/09 118/500
5,320,364 A * 6/1994 Mistrater ..... B23B 31/1175 198/803.7

(Continued)

FOREIGN PATENT DOCUMENTS

JP 01086145 A * 3/1989 ..... G03G 5/0525
JP 08-036267 A 2/1996

(Continued)

OTHER PUBLICATIONS

Machine Translation of JP2005049375A.*
International Search Report for PCT/KR2015/000470 dated Apr. 30, 2015 from Korean Intellectual Property Office.

*Primary Examiner* — David P Turocy
(74) *Attorney, Agent, or Firm* — Paratus Law Group, PLLC

(57) ABSTRACT

Disclosed is a method for manufacturing an organic photosensitive drum for electrophotography, which includes a step of immersing a hollow cylinder into a liquefied photosensitive material after gripping the hollow cylinder, by using a coating device including: a transfer tray in which the hollow cylinder is inserted and loaded into at least one jig vertically provided on a plate type pallet; and a gripping assembly disposed above the transfer tray and including at least one gripping mechanism. The process of gripping the hollow cylinder includes: inserting a portion or the whole of the gripping mechanism into the hollow cylinder; aligning a lower end of the gripping mechanism with a lower end of the hollow cylinder; and gripping the hollow cylinder by using the gripping mechanism.

7 Claims, 7 Drawing Sheets

(56) References Cited

U.S. PATENT DOCUMENTS

| | | | | | |
|---|---|---|---|---|---|
| 5,322,300 | A | * | 6/1994 | Mistrater | B23B 31/1175 198/803.7 |
| 5,324,049 | A | * | 6/1994 | Mistrater | B23B 31/1175 198/803.7 |
| 5,328,181 | A | * | 7/1994 | Mistrater | B05C 3/09 198/803.7 |
| 5,330,873 | A | * | 7/1994 | Doi | G03G 5/0436 430/127 |
| 5,578,410 | A | * | 11/1996 | Petropoulos | G03G 5/0525 427/430.1 |
| 5,893,568 | A | * | 4/1999 | Swain | B05C 13/025 269/48.1 |
| 2002/0094487 | A1 | * | 7/2002 | Kawasaki | G03G 5/047 430/58.05 |
| 2008/0102389 | A1 | * | 5/2008 | Inagaki | G03G 5/047 430/58.05 |
| 2009/0174156 | A1 | | 7/2009 | Schmitt | |

FOREIGN PATENT DOCUMENTS

| | | | | |
|---|---|---|---|---|
| JP | 10194661 | A | * | 7/1998 |
| JP | 2001-022103 | A | | 1/2001 |
| JP | 2005-049375 | A | | 2/2005 |
| JP | 2005049375 | A | * | 2/2005 |
| JP | 2005049375 | A | * | 2/2005 |
| KR | 10-2011-0120473 | A | | 11/2011 |

* cited by examiner

-Related Art-

-Related Art-

ORGANIC PHOTOSENSITIVE DRUM FOR ELECTRO-PHOTOGRAPHY AND MANUFACTURING METHOD THEREFOR

CROSS REFERENCE TO PRIOR APPLICATIONS

This application is a National Stage Patent Application of PCT International Patent Application No. PCT/KR2015/000470 (filed on Jan. 16, 2015) under 35 U.S.C. § 371, which claims priority to Korean Patent Application No. 10-2014-0005965 (filed on Jan. 17, 2014), which are all hereby incorporated by reference in their entirety.

TECHNICAL FIELD

The present invention relates to an organic photosensitive drum for electrophotography and a method for manufacturing the same.

BACKGROUND ART

An organic photosensitive drum used for a printer of an electrophotography method is manufactured by uniformly applying a photosensitive layer on an outer surface of a hollow cylinder made of metal or a conductive material. The above-described organic photosensitive drum may be classified into a single layer type and a function separated lamination type according to constitution of the photosensitive layer.

The single layer type organic photosensitive drum is manufactured by applying a lower layer having a thickness of 0.5 to 10 μm, more desirably 1 to 7 μm, on the outer surface of the hollow cylinder made of the metal or the conductive material as necessary, applying an electric charge generation transport layer containing all of an electric charge generation agent and an electric charge transport agent and having a thickness of 10 to 40 μm on the lower layer, and applying a protection layer having a thickness of 1 to 10 μm, more desirably 3 to 8 μm, as necessary on the electric charge generation transport layer. The function separated lamination type organic photosensitive drum is manufactured by applying a lower layer having a thickness of 0.5 to 10 μm, more desirably 1 to 7 μm, on the outer surface of the hollow cylinder made of the metal or the conductive material as necessary, sequentially applying an electric charge generation layer having a thickness of 0.1 to 5 μm, more desirably 0.2 to 2 μm, and an electric charge transport layer having a thickness of 10 to 40 μm on the lower layer, and applying a protection layer having a thickness of 1 to 10 μm more desirably 3 to 8 μm on the electric charge transport layer as necessary. Although a method for applying the photosensitive layer of the above-described single layer type or function separated lamination type organic photosensitive body includes a spray jet method, a ring-coating method, and an immersion coating method, the immersion coating is generally widely used in terms of uniformity and productivity of a formed layer.

FIG. 1 is a process conceptual view illustrating a photosensitive material coating method performed by a conventional general immersion method. The immersion coating method is a method in which the hollow cylinder 20 is vertically immersed into a photosensitive solution 30 and then taken out to apply and dry the photosensitive solution 30 to an outer surface of the hollow cylinder 20 in a state in which an inner surface of the hollow cylinder 20 is gripped by a gripping mechanism 120 such as a O-ring compression picker compressing an O-ring shaped elastic member to the inner surface of the hollow cylinder 20 in a mechanical method to expand an external diameter thereof or a balloon type air picker applying pneumatic pressure to a balloon shaped elastic member to be expanded. The above-described gripping mechanisms grip by closely attaching the elastic member of the gripping mechanism 20 to a portion of the inner surface of the hollow cylinder 20 and simultaneously secure inner sealing. Referring to the gripping process in a previous step of the immersion in detail, in a state in which the hollow cylinder 20 is vertically stood by a jig (not shown) inserted from a lower portion thereof, as an entire body of the gripping mechanism 120 is entered into to grip the hollow cylinder through an upper portion of the hollow cylinder 20 and then the gripping mechanism 120 is lifted, the hollow cylinder is carried out from the inserted jig.

In the above-described method, the hollow cylinder loaded on a transfer pallet and the gripping mechanism should be aligned with each other on an coaxial line at a high precision degree so that a plurality of gripping mechanisms mechanically fixed to a chuck are smoothly and respectively entered into a plurality of hollow cylinders, of which movement is restricted by the jig of the transfer pallet, vertically loaded on the transfer pallet. In particular, a coaxial line alignment error due to angular misalignment in the process of entering the gripping mechanism into the hollow cylinder is gradually deepened from an upper end to a lower end of the hollow cylinder. In detail, as the jig of the transfer pallet has an external diameter less by an appropriate difference than an internal diameter of the hollow cylinder, when the difference is great, the gripping mechanism firstly enters and a center of the hollow cylinder is moved by a gap formed by the difference to partially resolve the coaxial line misalignment. However, since initial coaxial line alignment between the gripping mechanism and the hollow cylinder is unfavorable, possibility of failure on the initial entry of the gripping mechanism increases. On the contrary, when the difference is too small, the initial coaxial line alignment between the gripping mechanism and the hollow cylinder becomes better. However, since the gap in which the center of the hollow cylinder is moved is small when the gripping mechanism enters, the coaxial misalignment caused by the angular misalignment is deepened to cause damage to the gripping mechanism and the hollow cylinder or generate a problem in which the hollow cylinder is not separated from the jig even when gripped.

Meanwhile, since in the related art, a final position at which the gripping mechanism 120 grips an inner surface of the hollow cylinder 20 includes a distance from a lower end of the hollow cylinder 20 to an upper end of the jig inserted in an upward direction, the final position is restricted to a considerably spaced position to form a considerable space from a position in which the elastic member of the gripping mechanism is closely attached to the inside of the hollow cylinder to the lower end thereof, which generates a problem that will be described later in the coating process.

In general, the photosensitive solution used in the immersion coating process is generally prepared by dissolving or diffusing a bonding agent resin or a photosensitive material into an organic solvent. Here, as the used organic solvent, toluene, tetrahydrofuran, dichloromethane, 1,2-dichloroethane, monochlorobenzene, ethyl acetate, butyl acetate, cyclohexanone, methanol, butanol, and the like are singly used or used in combination thereof.

A photosensitive layer coating process in the immersion coating is performed such that as the hollow cylinder is vertically immersed into the liquefied photosensitive solution and then taken out therefrom, the liquefied photosensitive solution is applied on the surface of the hollow cylinder to form a wet-coated film, and then the solvent is evaporated from the applied photosensitive solution wet-coated film and dried to be cured to form the photosensitive layer.

Meanwhile, since the immersion coating method is performed in the vertical direction, the applied photosensitive solution may flow downward due to gravitational influence to generate deviation in coating amount between upper and the lower portions. Although the amount of the photosensitive solution is sometimes insufficient not to flow downward, when the solvent is evaporated form the coated photosensitive solution wet-coated film, deviation in photosensitive solution density of the wet-coated film may be generated, a convection phenomenon may be generated, and as a result, a problem of a spot shape in which the deviation in coating amount is generated by positions may be generated.

When the deviation in the coating amount occurs irregularly in positions and upper and lower portions of the photosensitive layer over an entire area of the photosensitive drum, image deviation having the same shape of the coating amount deviation is generated in a printed image, and thus uniform coating of the photosensitive layer is very important in quality of the photosensitive body. In particular, in a color printer mixing four colors to express an image, a problem caused by the deviation in photosensitive layer coating amount is further serious because it generates color distortion in addition to a simple image density deviation in comparison with a mono printer using a single color. To solve the above-described problem, a quick drying solution of the photosensitive material should be prepared so that the wet-coated film formed on the surface of the hollow cylinder during the immersion coating is not flown downward or the spot is not generated and quickly dried.

Since an evaporation speed of the used solvent is considered to prepare the quick-drying photosensitive solution, the evaporation speed of the solvent is generally expressed as a relative evaporation speed by calculating, on the basis of time required for evaporating ether of 1, time required for evaporating the same amount of different solvent. Among various kinds of solvents used as the photosensitive solution, since toluene having the relative evaporation speed of 6.1, monochlorobenzene having the relative evaporation speed of approximately 10, or butyl acetate having the relative evaporation speed of 11 have the slow evaporation speed, as curing thereof has slowly progressed to lengthen time for staying as a liquid state of an uncured state on the outer surface of the hollow cylinder, the amount flowing downward is great to generate great deviation in upper and lower portions of the thickness of the coated film of the photosensitive drum cylinder, or as the convection phenomenon is continued while the wet-coated film state is maintained for a long time to easily generate the spot, the solvent may not be singly used and thus used as a solvent added to retard the evaporation speed of other solvents. On the other hand, in case of dichloromethane, since it has very fast relative evaporation speed of 1.8, it is favorable in terms of reducing deviation in the photosensitive layer coating amount of the photosensitive drum cylinder. However, since density of the inputted photosensitive solution extremely increases because rapid evaporation of the solvent is continued while processing the process, difference in the coating amounts between the initially produced photosensitive drum cylinder and latter produced photosensitive drum cylinder during production is generated. When the solvents such as tetrahydrofuran (relative evaporation speed of 2.3), 1,2-dichloroethane (relative evaporation speed of 2.7), ethyl acetate (relative evaporation speed of 3), or the like is used as a main solvent, since it effectively reduces the deviation in coating amount according to the upper and lower portions and positions of the photosensitive drum cylinder and has volatility enabling the density of the photosensitive solution not to be greatly changed, it may be used as the main solvent. Alternatively, the dichloromethane having the very fast relative evaporation speed is mixed with toluene, monochlorobenzene, or the like, which has very slow relative evaporation speed, to have the appropriate evaporation speed, thereby being used as the main solvent.

In this case, referring to FIG. 1, when a hollow cylinder 20 is immersed into a photosensitive solution 30 for immersion coating, a sealed space 40 is defined between a gripping mechanism 120 and a liquid surface of the photosensitive solution in the hollow cylinder 20, and high volatile solvents are fast evaporated to be diffused into the sealed space 40 so that evaporation vapor increases a total gas volume in the sealed space 40. The above-described solvent evaporation on a liquid surface at a lower portion of the sealed space 40 is continued until the sealed space 40 is saturated by the vapor of the corresponding solvent, and thus the volume of the gas of the vapor element of the newly generated solvent pushes the liquid surface at the lower end of the hollow cylinder 20 to be downward protruded, and bubbles are eventually discharged toward the photosensitive solution 30. The discharged bubbles float from the lower end of the hollow cylinder 20 up to the liquid surface of an upper portion of the photosensitive solution 30, and are taken out to be attached to the outer surface of the hollow cylinder 20 and broken-up, so that the bubble break-up is marked in a bubble break-up region of the coated film to generate a defect.

To improve the above-described problem, provided is a method in which a hole for discharging air is defined in the gripping mechanism 120 to discharge a predetermined amount of inner air to the outside while the hollow cylinder 20 is immersed into the photosensitive solution 30 in a state the hollow cylinder 20 is gripped by the gripping mechanism in an initial coating process, and the photosensitive solution 30 is introduced into the hollow cylinder 20 as many as the volume of the discharged air to raise the liquid surface of the photosensitive solution 30 by a predetermined distance from the lower end of the hollow cylinder 20 (refer to FIG. 2). In this case, although the solvent is rapidly evaporated from the liquid surface raised by a predetermined distance from the lower end of the hollow cylinder 20 in the coating process, the liquid surface is lowered only as many as the volume increased due to the generated solvent vapor, and the bubbles are not discharged to the external photosensitive solution 30 outside the hollow cylinder. As a result, as the photosensitive solution 30 prepared by using the solvent having the fast evaporation speed is used, the photosensitive drum having the small deviation in photosensitive coating amount may be manufactured. However, in the above-described method, the manufacturing cost increases because the high-priced photosensitive solution 30 is unnecessarily applied to the inner surface as well as the outer surface, which is a functional part of a product, of the hollow cylinder 20.

The applying of the photosensitive material to the inner surface of the photosensitive drum has another problem as follows in addition to the cost increase problem. A gear or a bearing element including a grounding electrode is assembled to an inner surface of both ends or one side end of the photosensitive drum to which the coating of the photosensitive layer is completed in a press-fit method. Since the press-fit assembly is impossible when the photosensitive layer is applied on the inner surface, the photosensitive layer of the unnecessarily coated inner surface needs to be wiped out by using a sponge or a brush immersed into an organic solvent, and thus additional process is added to thereby increase the manufacturing cost. In addition to the problem in the manufacturing process, in the photosensitive drum manufactured by the related art method, since the coating layer of the inner surface is not easily and completely removed by the wiping process, degree of precision in assembling parts such as the gear and the bearing element may be affected, and thus a problem may occur in terms of mechanical element quality such as the runout tolerance of the photosensitive drum. Since the runout tolerance of the photosensitive drum directly affects an amount of toner transferred from a developing roller to a photosensitive drum, when the runout tolerance of the photosensitive drum is over regulatory criteria, nonuniformity of an image may be seriously generated.

DISCLOSURE OF THE INVENTION

Technical Problem

A first objective of the present invention is to provide a method for manufacturing an organic photosensitive drum for electrophotography, which is capable of minimizing a gripping failure problem that may occur due to a misalignment condition of a coaxial line between a jig and a cylinder when a gripping mechanism fixed to a chuck is entered into a hollow cylinder.

A second objective of the present invention is to provide the new organic photosensitive drum for electrophotography, which is capable of preventing a defect due to discharge of solvent vapor bubbles and break-up of the discharged bubbles from occurring even without applying an high-priced photosensitive solution to an inner surface of the photosensitive drum in an immersion coating process even when quick-drying photosensitive solution prepared by using a high volatile solvent is used to minimize deviation in a coating amount of the photosensitive layer, to reduce a cost of a raw material of the photosensitive drum because the high-priced photosensitive solution is not applied to the inner surface of the photosensitive drum and save a processing cost because the photosensitive solution unnecessarily applied to the inner surface is not necessary to be wiped again.

A third objective of the present invention is to provide the organic photosensitive drum for electrophotography, which is capable of enhancing uniformity of image density because deviation in the coating amount of the photosensitive layer is small and acquiring excellent image quality because the inner surface is not coated at all to have a low runout tolerance even after a gear or a bearing element is assembled.

Technical Solution

The gist of the present invention related to the above-described subject to be solved is as follows.

Embodiments of the present invention provide methods for manufacturing an organic photosensitive drum for electrophotography, which include a step of immersing a hollow cylinder into a liquefied photosensitive material after gripping the hollow cylinder, by using a coating device including: a transfer tray in which the hollow cylinder is inserted and loaded into at least one jig vertically provided on a plate type pallet; and a gripping assembly disposed above the transfer tray and including at least one gripping mechanism, the method being characterized in that, the gripping of the hollow cylinder includes: a step (a) of inserting a portion or the whole of the gripping mechanism into the hollow cylinder; a step (b) of aligning a lower end of the gripping mechanism with a lower end of the hollow cylinder; and a step (c) of gripping the hollow cylinder by using the gripping mechanism.

In some embodiments, the step (b) may include: a step (b-1) of gripping an intermediate portion of the hollow cylinder by using the gripping mechanism; a step (b-2) of lifting the gripping mechanism to carry out the jig from the hollow cylinder; a step (b-3) of releasing the gripping mechanism in a state in which the lower end of the hollow cylinder is supported; and a step (b-4) of aligning the lower end of the gripping mechanism with the lower end of the hollow cylinder.

In other embodiments, in the step (b-1), the lower end of the hollow cylinder may be supported on the plate type pallet or by using a separate plate type member.

In still other embodiments, the transfer tray may further include a support plate having a jig entry hole through which the jig passes and mounted slidable along the jig between a top surface of the plate type pallet and an upper end of the jig, and the step (b) may be performed by lifting the support plate to a height that is above a height of the upper end of the jig to support the lower end of the hollow cylinder.

In even other embodiments, the coating device may further include a hollow cylinder lifting mechanism including a lifting member and a driving unit for elevating the lifting member, and at least one lifting member entry hole formed around the jig and exposing a portion of the lower end of the hollow cylinder installed in the jig may be defined in the plate type pallet, and the step (b) may be performed by lifting the lifting member to a height that is above a height of an upper end of the jig to support the lower end of the hollow cylinder.

In yet other embodiments, the gripping mechanism may use a contractible/expandable elastic member.

In further embodiments, the gripping mechanism may include an air picker or an O-ring compression picker.

In other embodiments of the present invention, organic photosensitive drums for electrophotography, in which at least one photosensitive material layer is provided on a hollow cylinder, is characterized in that the at least one photosensitive material layer is prepared as a photosensitive solution containing a single or mixed solvent having a relative evaporation speed of 1.9 to 5 with respect to ether and applied to only an outer surface of the hollow cylinder.

Advantageous Effects

The method for manufacturing the organic photosensitive drum according to the present invention may minimize the occurrence of the gripping failure problem because the state in which the movement of the hollow cylinder is restricted by the jig of the transfer tray in the process of aligning the plurality of gripping mechanisms fixed to the chuck with the lower ends of the plurality of hollow cylinders is resolved to resultantly freely move the center of the hollow cylinder to the position of the gripping mechanism.

The method for manufacturing the organic photosensitive drum according to the present invention, as the space formed between the gripping mechanism and the liquid surface of the photosensitive solution in the hollow cylinder is minimized even in the case of using the high volatile photosensitive solution to reduce the deviation in the coating amount of the photosensitive layer, the vapor of the photosensitive solvent is rapidly evaporated in the space to reach the vapor-liquid equilibrium state in which evaporation and condensation on the liquid surface of the lower end of the hollow cylinder maintain equilibrium therebetween, and thus the solvent in the photosensitive solution on the liquid surface of the lower end of the hollow cylinder may not be further evaporated, and resultantly the increase in volume of new vapor gas in the space may not occur. Accordingly, although the high volatile photosensitive solution is used, as the defect in which bubbles are discharged is not generated even when the photosensitive solution is not introduced into the hollow cylinder like the related art, the high-priced photosensitive solution may be prevented from being wasted because the photosensitive material is not applied to the inner surface, and also the manufacturing cost of the photosensitive drum may be reduced because the photosensitive solution unnecessarily applied to the inner surface of the photosensitive drum is not necessarily wiped again.

Also, the method for manufacturing the organic photosensitive drum according to the present invention may prevent the discharge of the photosensitive solution vapor and bubble break-up even in case of using the photosensitive solution containing the high volatile single or mixed solvent, which has the relative evaporation speed of 1.9 to 5, desirably 2 to 3, with respect to ether to reduce the deviation between the upper and lower portions of the coated film. Thus, the above-described organic photosensitive drum may improve the uniformity of the image density due to the low deviation in the coating amount of the photosensitive layer and acquire excellent image quality because the inner surface is not coated at all to lower the runout tolerance even after the gear or the bearing element is assembled.

MODE FOR CARRYING OUT THE INVENTION

Figure 1:
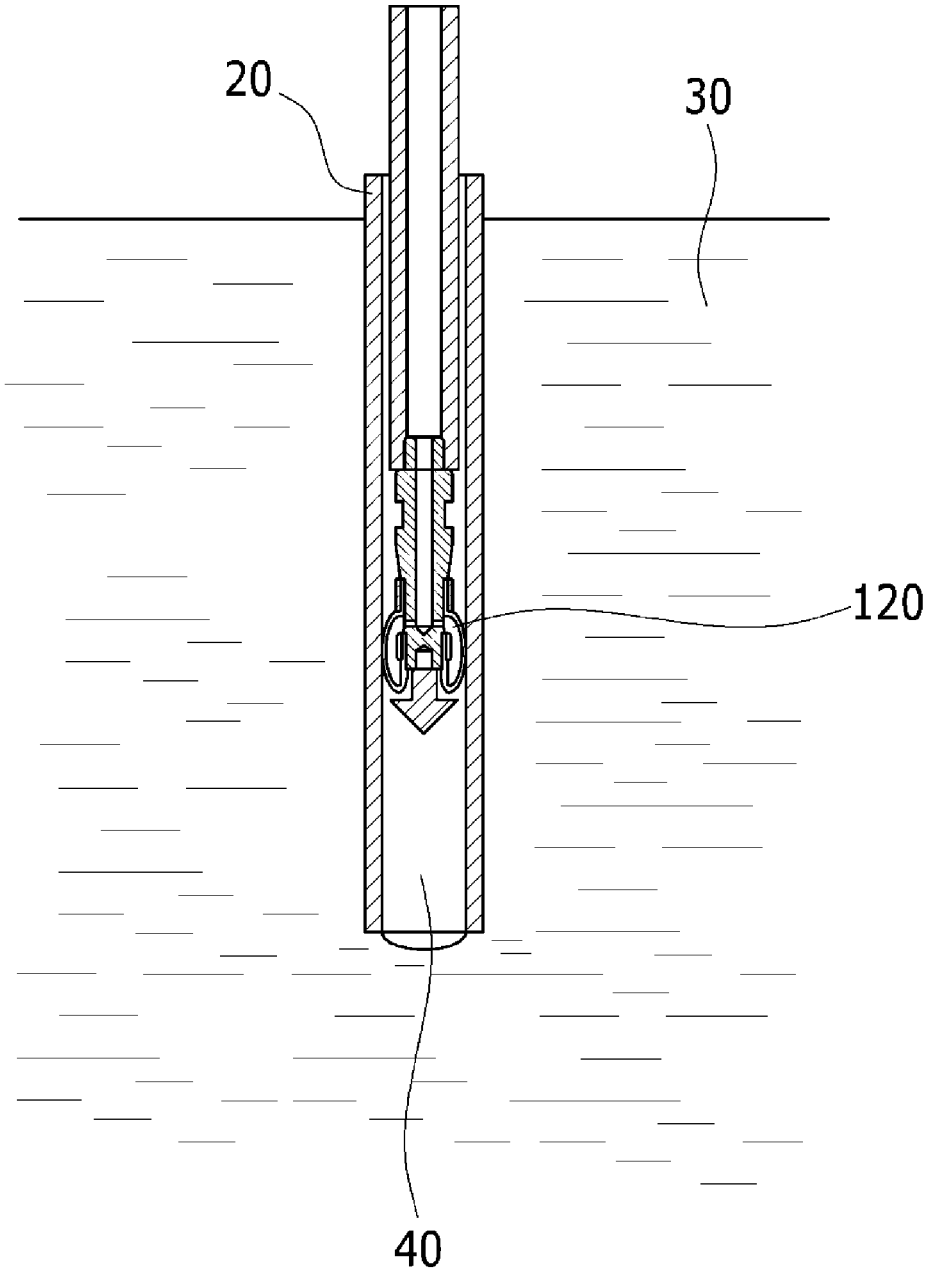
FIG. 1 is a process conceptual view illustrating an immersion coating method of a photosensitive material with respect to a conventional hollow cylinder.
Figure 2:
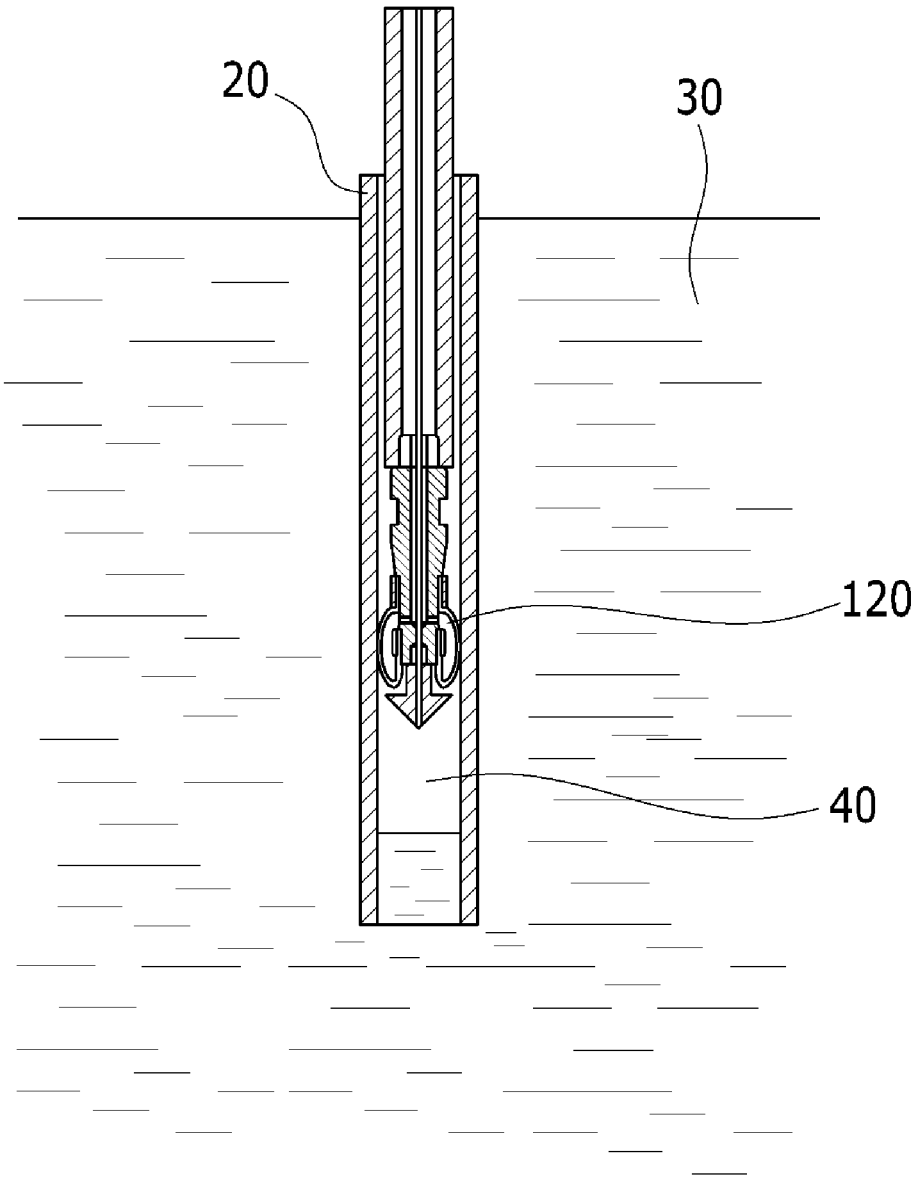
FIG. 2 is another process conceptual view illustrating an immersion coating method of a photosensitive material with respect to a conventional hollow cylinder.

Hereinafter, embodiments according the present invention will be described with reference to the accompanying drawing. Like reference numerals are used for referring to the same or similar elements in the description and drawings. Furthermore, when it is described that one comprises (or includes or has) some elements, it should be understood that it may comprise (or include or has) only those elements, or it may comprise (or include or have) other elements as well as those elements if there is no specific limitation.

Meanwhile, hereinafter, a 'hollow cylinder' represents a structure in a process before a photosensitive material is applied, and a 'photosensitive drum' or 'photosensitive drum cylinder' represents a structure in a state in which the photosensitive material is applied to the hollow cylinder. Thus, they need to be separately described.

Figure 3:
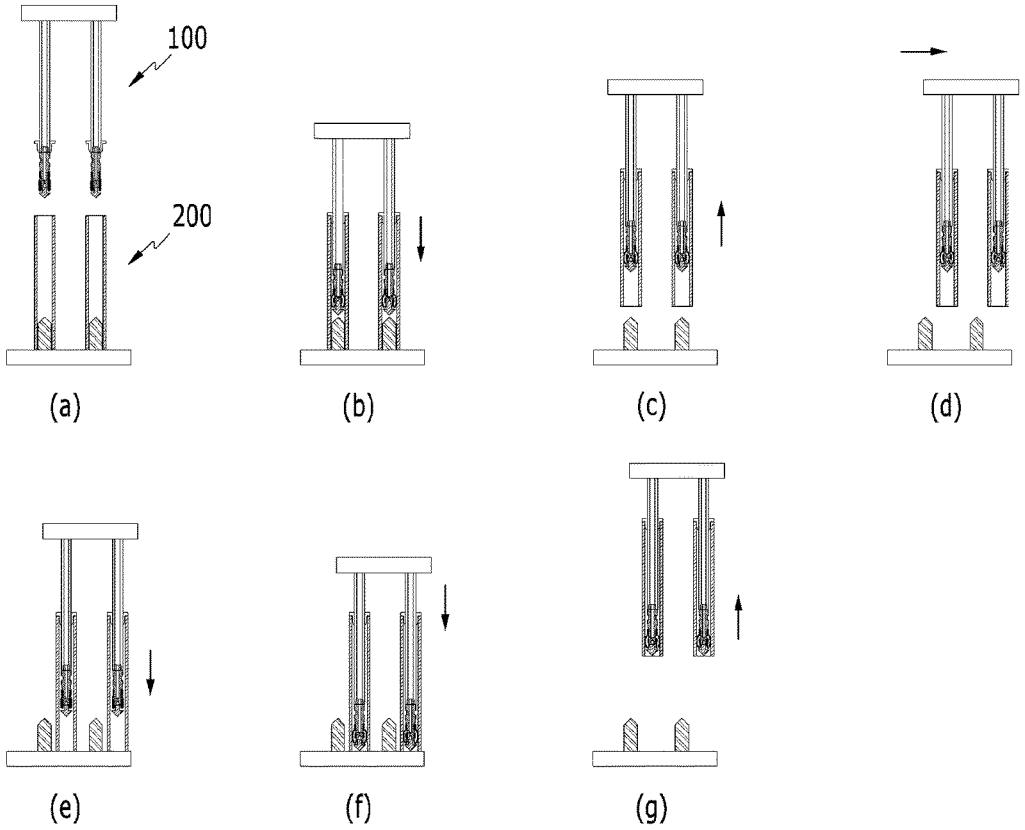
FIG. 3 is a process conceptual view illustrating an immersion coating method of a photosensitive material with respect to a hollow cylinder according to a first embodiment of the present invention.
Figure 4:
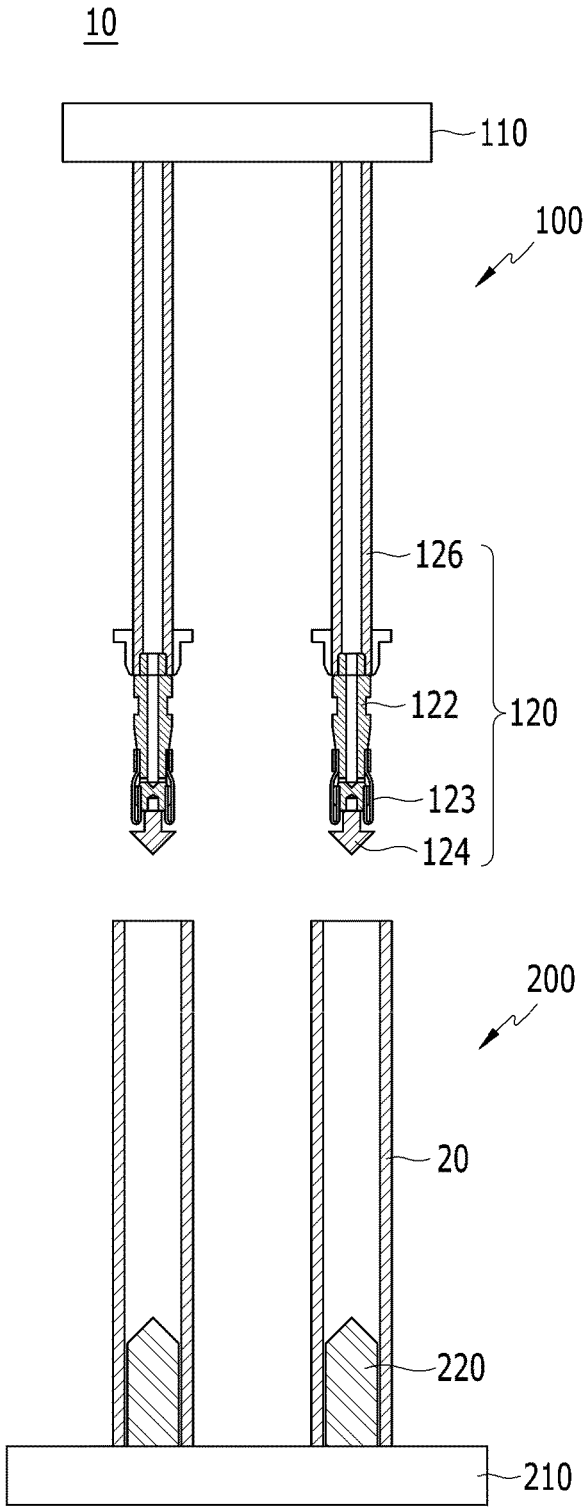
FIG. 4 is an enlarged cross-sectional view illustrating a gripping mechanism and a transfer tray according to the first embodiment.

FIG. 3 is a process concept view illustrating a method for applying the photosensitive material to a hollow cylinder according to a first embodiment of the present invention, and FIG. 4 is an enlarged cross-sectional view illustrating a gripping mechanism and a transfer tray according to the first embodiment.

The applying of the photosensitive material to the hollow cylinder is performed by a coating device 10 including a transfer tray 200 including at least one jig 220 fixed to a top surface of a plate type pallet 210 and a gripping assembly 100 including a plurality of gripping mechanisms 120 provided on a bottom surface of a base plate 110. Here, the number of the plurality of gripping mechanisms 120 corresponds to that of the jig 220.

The transfer tray 200 is transferred toward a lower portion of the gripping assembly 100 to perform a coating process in a state in which a hollow cylinder 20 is inserted and loaded into the jig 220 by a transfer unit (not shown) such as a conveyor. The plate type pallet 210 of the transfer tray 200 may be aligned to an exact position on an elevating movement path of the gripping assembly 100 by a separate alignment mechanism (not shown) fixed around the transfer unit such as the conveyor.

The gripping assembly 100 may be disposed above the moving path of the transfer unit, elevate to the transfer tray 200 transferred to grip the hollow cylinder 20, and horizontally move and elevate to a photosensitive solution accommodation container (not shown) that is separately provided while gripping the hollow cylinder 20.

The gripping mechanism 120 includes a hollow rod 126 fixed to a bottom surface of the base plate 110 and an air picker 122 coupled to an end of the hollow rod 126.

An elastic member 123 contracted/expanded on the basis of introduction/discharge of fluid (air) controlled through a solenoid valve is provided on an end of the air picker 122. When the fluid is introduced, the elastic member 123 expands to be closely attached to an inner wall surface of the hollow cylinder 20 and grip the hollow cylinder 20, and when the fluid is discharged, the elastic member 123 is contracted to release the closely attached state with the hollow cylinder 20.

Selectively, an entry guide 124 of which an end is tapered may be provided on the end of the air picker 122 for easy entry into the hollow cylinder 20.

Meanwhile, according to embodiments in FIGS. 3 and 4, although the air picker 122 is exemplarily illustrated as the gripping mechanism, other gripping mechanisms such as O-ring compression picker, which may grip the hollow cylinder 20 through contacting the expanded elastic member to the inner surface of the hollow cylinder 20 and intentionally control the gripping process, are possibly used.

An immersion coating process of a photosensitive material according to the present invention is basically performed such that the hollow cylinder 20 is gripped by the gripping mechanism 120, and then immersed into the liquefied photosensitive material.

Unlike a conventional method in which in the process of gripping the hollow cylinder 20, the gripping mechanism 120 is inserted into only a portion of an upper side in the cylinder 20 to grip the cylinder 20 in a state in which entry is limited by an entry limit position provided on an upper end of the jig inserted into the cylinder 20, the present invention further include a process of aligning the gripping mechanism 120 to a lower end of the hollow cylinder 20 before final gripping.

Referring to FIG. 3, the above-described inserting, aligning, and gripping will be described in detail.

Firstly, the gripping assembly 100 is lowered to the transfer tray 200 aligned thereto to insert the gripping mechanism 120 to be spaced by a predetermined distance from an upper end of the jig 220 disposed in the hollow cylinder 20 (steps of (a) and (b) in FIG. 3).

Continuously, the elastic member 123 disposed on the end of the air picker 122 of the gripping mechanism 120 is expanded to grip an intermediate portion of the hollow cylinder 20 in a state in which lower end alignment is not performed between the gripping mechanism 120 and the hollow cylinder 20, and then the gripping assembly 100 including the gripping mechanism 120 is lifted to carry out the jig 220 from the hollow cylinder 20 (step (c) in FIG. 3).

Thereafter, the gripping assembly 100 horizontally moves, then is lowered onto the plate type pallet 210 of the transfer tray 200 so that the lower end of the hollow cylinder 20 is supported, and then the expansion state of the elastic member 123 is relaxed to be released (steps (d) and (e) in FIG. 3). In this case, the lower end of the hollow cylinder 20 may be supported by using the plate type pallet 210 of the transfer tray 200 like the above-described embodiment or on a separate plate type member (not shown).

Thereafter, the gripping assembly 100 is further lowered to align a lower end of the gripping mechanism to the lower end of the hollow cylinder 20 (step (f) in FIG. 3).

Thereafter, the elastic member 123 expands to grip the hollow cylinder 20, and then the gripping assembly 100 is moved to a place in which the photosensitive solution is accommodated to complete the gripping process (step (g) in FIG. 3).

Through the lower end alignment of the gripping mechanism 120 with respect to the hollow cylinder 20 before gripping, in the gripping state, a space formed between a surface of a lower portion of the gripping mechanism 120 and the inner wall surface of the hollow cylinder 20 in a lower side of the hollow cylinder 20 may be minimized. Accordingly, since an inner space of the hollow cylinder 20 is directly reached to a saturation state by solvent vapor in the immersion coating process, solvent evaporation in a liquid surface formed to the lower end of the hollow cylinder 20 may be restrained, and bubble discharge from an inside of the hollow cylinder 20 may be prevented to use solvent having a rapid evaporation speed in preparing the photosensitive solution although the photosensitive solution is not introduced into the hollow cylinder 20 like the related art. As a result, uniformity in the coating amount of the photosensitive layer may be secured, and thus the photosensitive material applied to the inner wall surface of the hollow cylinder 20 may be restrained to reduce a preparing cost.

Meanwhile, although the lower end alignment of the gripping mechanism 120 with respect to the hollow cylinder 20 according to an embodiment in FIG. 3 may be simply accomplished by controlling only operation of the gripping assembly 100 and the gripping mechanism 120 in a state an existing facilities is used as it is in a method performed through the elevating and horizontal movement operation of the gripping assembly 100 and the gripping the intermediate portion and releasing process of the gripping mechanism 120, it is not the best method in terms of process efficiency because the number of a unit process for alignment increases and a processing time is retarded.

Figure 5:
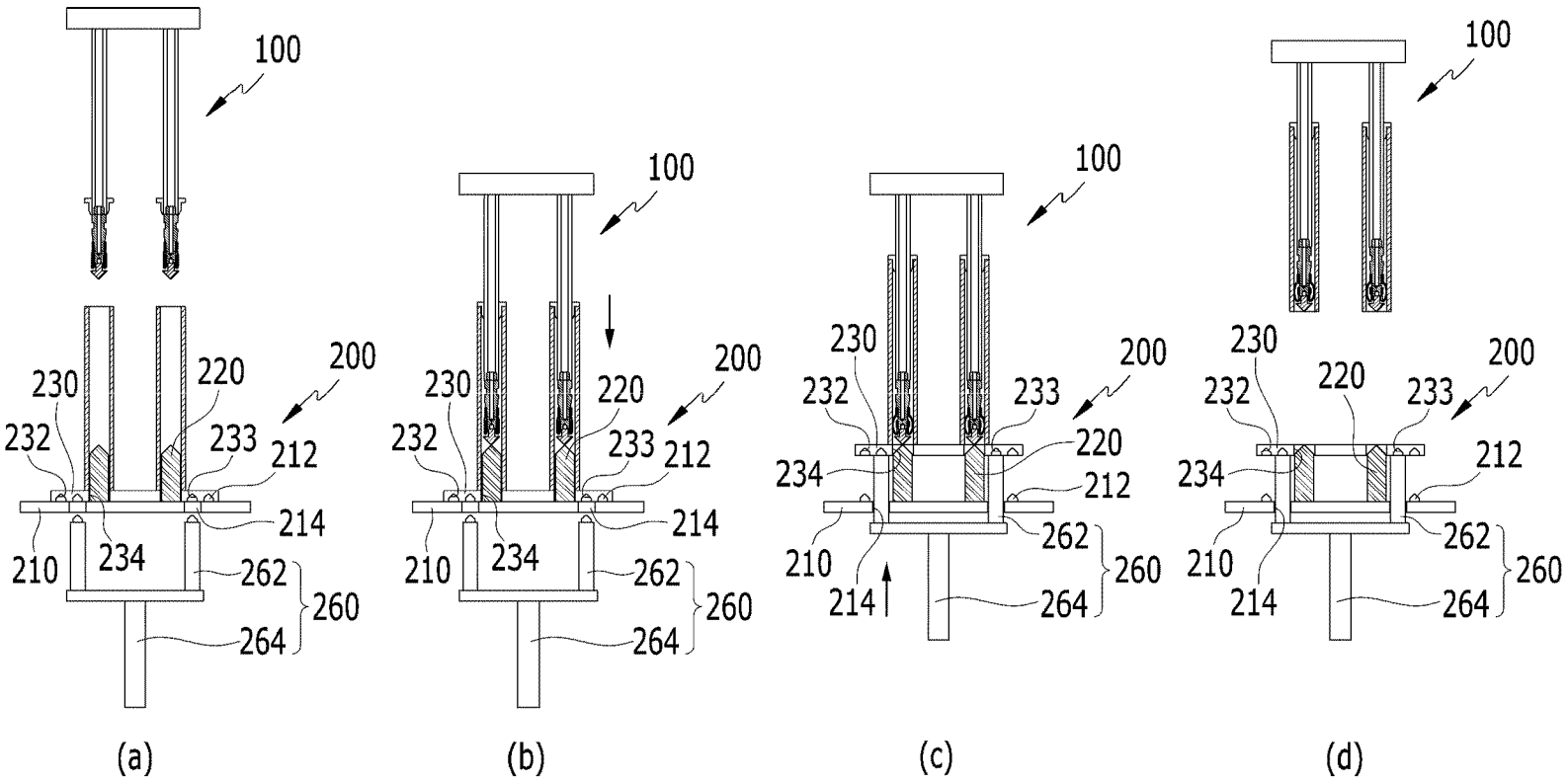
FIG. 5 is a process conceptual view illustrating an immersion coating method of a photosensitive material with respect to a hollow cylinder according to a second embodiment of the present invention.

FIG. 5 is a process conceptual view illustrating a method of applying the photosensitive material to the hollow cylinder according to a second embodiment of the present invention. FIG. 5 illustrates an embodiment in which the process efficiency in the lower end alignment process of the gripping mechanism 120 with respect to the hollow cylinder 20 is improved in comparison with that of the first embodiment.

According to the second embodiment, the constitution and operation of the gripping assembly 100 may be the same as those according to the first embodiment of FIG. 3, the transfer tray 200 may include at least one jig 220 fixed to the top surface of the plate type pallet 210 like the first embodiment in FIG. 3 and be transferred below the gripping assembly 100 by the transfer unit (not shown) such as a conveyor to perform the coating process in a state the hollow cylinder 20 is inserted and loaded into the jig 220, and the plate type pallet 210 of the transfer tray 200 may be aligned to the exact position on the elevating movement path of the gripping assembly 100 by the separate alignment mechanism (not shown) fixedly installed around the transfer unit such as the conveyor.

Meanwhile, according to the second embodiment, to perform the lower end alignment process of the gripping mechanism 120 with respect to the hollow cylinder 20, the transfer tray 200 further includes a support plate 230 installed on the top surface of the plate type pallet 210 and including a jig entry hole 234 through which the jig 220 passes to be mounted vertically slidable along the jig 220 between the top surfaced of the plate type pallet 210 and the upper end of the jig 220. In this case, a size and shape of a cross-section of the jig entry hole 234 is determined in an appropriate shape and range in which the jig 220 passes and the hollow cylinder 20 does not pass.

To align the support plate 230 to a fixed position on the plate type pallet 210, a position alignment pin 212 may be formed on the top surface of the plate type pallet 210, and, in correspondence thereto, a position alignment hole 232 coupled to the position alignment pin 212 may be formed in the support plate 230.

The support plate 230 vertically moves by an elevating mechanism 260 provided on a lower portion of a conveyor transfer unit (not shown). The elevating mechanism 260 includes a plurality of elevating pins 262 for supporting the support plate 230 and a driving unit such as an electric motor or a pneumatic cylinder 264 for elevating the plurality of elevating pins 262. A coupling hole 233 coupled to an end of the elevating pin 262 is provided to the support plate 230, and an elevating pin entry hole 214 through which the elevating pin 262 passes is defined in the plate type pallet 230.

In a gripping process with respect to the hollow cylinder 20 according to the second embodiment, like the first embodiment, the gripping assembly 100 is firstly lowered to the transfer tray 200 aligned thereto to insert the gripping mechanism 120 into the hollow cylinder 20 until the upper end of the jig 220 disposed therein (steps (a) and (b) in FIG. 5).

Thereafter, as the elevating pin 262 is lifted through the elevating pin entry hole 214 of the plate type pallet 230 by using the pneumatic cylinder 264, the support plate 230 coupled to the elevating pin 262 by the coupling hole 233 is guided by the jig 220 through the jig entry hole 234 and lifted until the upper end of the jig 220, thereby supporting the lower end of the hollow cylinder 20 (step (c) in FIG. 5).

Thereafter, like the first embodiment, the elastic member 123 is expanded to grip the hollow cylinder 20, and then the gripping assembly 100 is moved to a place in which the photosensitive solution is accommodated to complete the gripping process (step (d) in FIG. 5).

In the second embodiment in FIG. 5, the lower end alignment process of the gripping mechanism 120 with respect to the hollow cylinder 20 may be realized by only the lifting operation of the support plate 230 separately provided to the transfer tray 200 to simplify an entire process in comparison with that in first embodiment.

Figure 6:
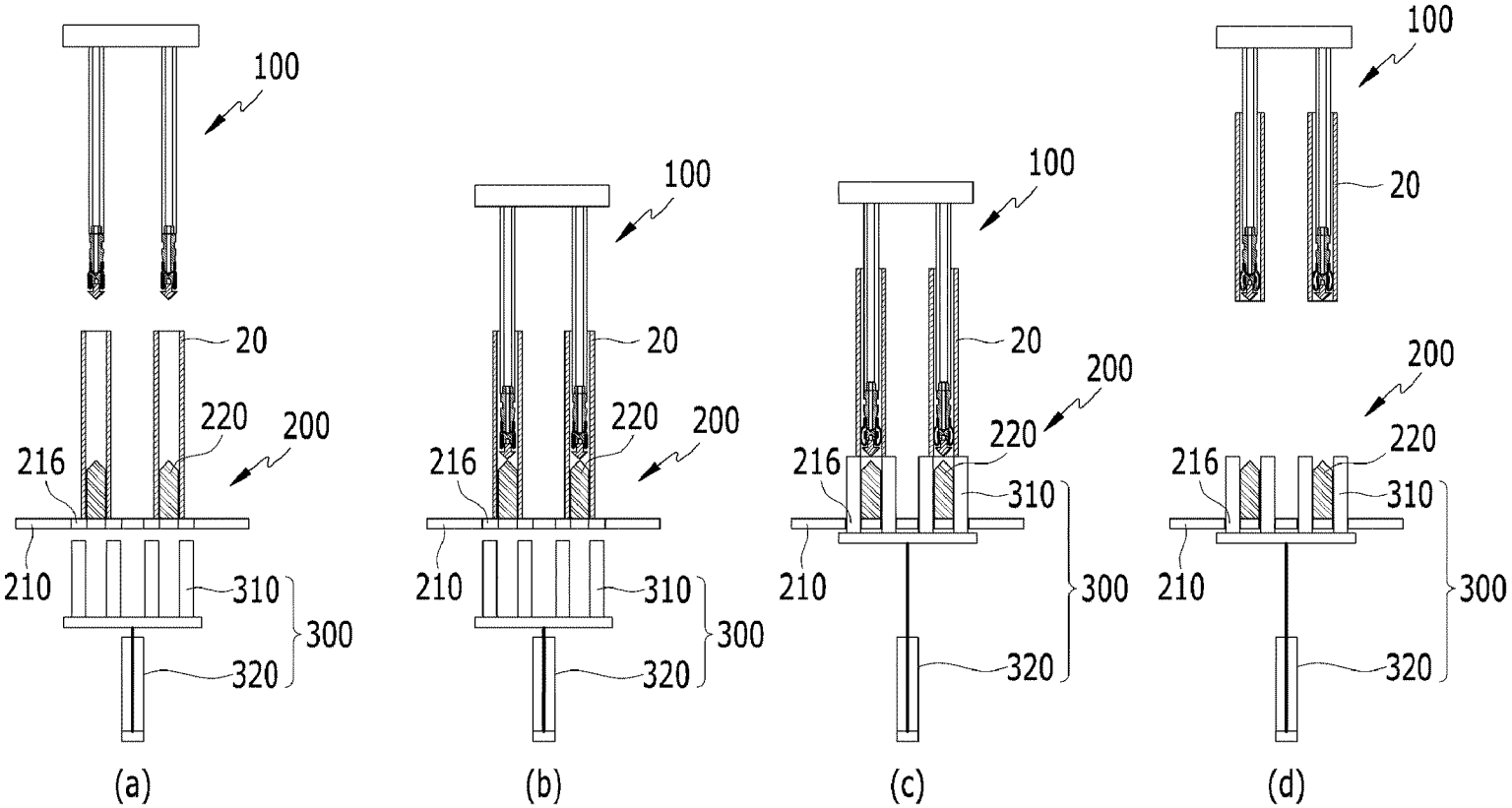
FIG. 6 is a process conceptual view illustrating an immersion coating method of a photosensitive material with respect to a hollow cylinder according to a third embodiment of the present invention.
Figure 7:
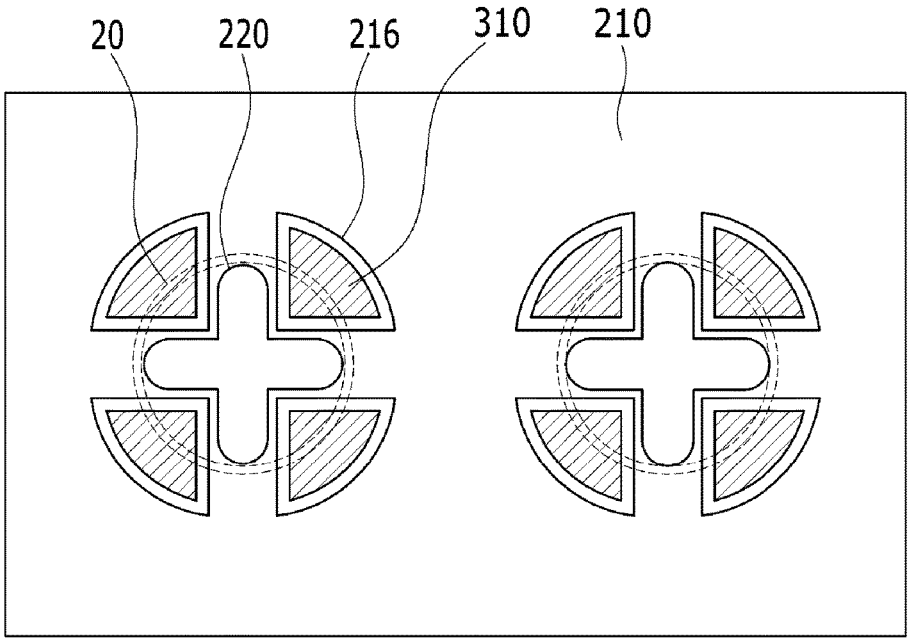
FIG. 7 is a plan view illustrating a transfer tray according to the third embodiment of FIG. 6.

FIG. 6 is a process conceptual view illustrating a photosensitive material immersion coating method of the hollow cylinder according to a third embodiment, and FIG. 7 is a plan view of a transfer tray according to the third embodiment in FIG. 6. The third embodiment in FIGS. 6 and 7 is an embodiment in which as a modified example of the second embodiment, process efficiency in the lower end alignment process of the gripping mechanism 120 with respect to the hollow cylinder 20 is improved in comparison to that in the first embodiment.

According to the third embodiment, the constitution and operation of the gripping assembly 100 may be the same as those according to the first and second embodiments, the transfer tray 200 may include at least one jig 220 fixed to the top surface of the plate type pallet 210 like the first and second embodiments and be transferred below the gripping assembly 100 by the transfer unit (not shown) such as a conveyor to perform the coating process in a state the hollow cylinder 20 is inserted and loaded into the jig 220, and the plate type pallet 210 of the transfer tray 200 may be aligned to the exact position on the elevating movement path of the gripping assembly 100 by the separate alignment mechanism (not shown) fixedly installed around the transfer unit such as the conveyor.

Meanwhile, in the third embodiment, to perform the lower end alignment process of the gripping mechanism 120 with respect to the hollow cylinder 20, the coating device 10 further includes a cylinder lifting mechanism 300 including a lifting member 310 and a driving unit 320 for lifting the lifting member. The driving unit 320 may be realized as a shape of an electric motor or a pneumatic cylinder. Also, referring to FIG. 7, at least one lifting member entry hole 216 formed around the jig 220 and exposing a portion of the lower end of the hollow cylinder 20 installed in the jig is formed in the plate type pallet 210.

In a gripping process of the hollow cylinder 20 according to the third embodiment, like the second embodiment, the gripping assembly 100 is firstly lowers to the transfer tray 200 aligned thereto to insert the gripping mechanism 120 into the hollow cylinder 20 until the upper end of the jig 220 disposed therein (steps (a) and (b) in FIG. 6)

Thereafter, the lifting member 310 supports the lower end of the hollow cylinder 20 in the process in which the lifting member passes through the lifting member entry hole 216 and is lifted until the upper end of the jig 220 by the driving unit 320 (step (c) in FIG. 6).

Thereafter, like the second embodiment, the elastic member 123 is expanded to grip the hollow cylinder 20, and then the gripping assembly 100 is moved to a place in which the photosensitive solution is accommodated to complete the gripping process (step (d) in FIG. 6).

The lower end alignment process of the gripping mechanism 120 with respect to the hollow cylinder 20 according to the third embodiment in FIGS. 6 and 7 may be realized by only the lifting operation of the cylinder lifting mechanism 300 additionally provided to the coating device 10 to simplify the entire process in comparison with that of the first embodiment and simplify the structure of the transfer tray 200 in comparison with that of the second embodiment.

Embodiment 1

The aluminum hollow cylinder having an external diameter of 30 mm, an internal diameter of 28.5 mm, and a length of 357 mm is mirror-surface finished, and a lower end thereof is gripped while spaced apart by a distance of 5 mm from a lower end of an air picker, and then a surface thereof is coated with a lower coating layer coating solution prepared by mixing 70 parts by weight of polyamide resin (CM8000, Toray Inc.) and 930 parts by weight of methanol. The lower coating layer coating solution is applied to an outer surface of the aluminum hollow cylinder by using an immersion coating method to form a lower coating layer having a film thickness after drying of approximately 0.5 μm.

The lower end of the half-finished photosensitive drum having the lower coating layer is gripped while spaced apart by a distance of 5 mm from the lower end of the air picker, and then a solution prepared such that, as an electric charge generation layer, 3 parts by weight of polyvinyl butyral resin (BX-1, Sekisui Inc.) is dissolved in 94 parts by weight of tetrahydrofuran, and 3 parts by weight of Y-oxy titanium phthalocyanine (TPL-3, Orient Inc.) pigment is diffused is applied and the electric charge generation layer having a film thickness after drying of approximately 0.2 μm is formed.

The lower end of the above-described prepared half-finished photosensitive drum is gripped while spaced apart by a distance of 5 mm from the lower end of the air picker, and lowered into a photosensitive solution for an electric charge transport layer, in which at a speed of 10 mm/sec and then stopped for 1 second to stabilize the photosensitive solution, lifted again at a speed of 5 mm/sec to apply the photosensitive solution for the electric charge transport layer. Here, the photosensitive solution for an electric charge transport layer is prepared such that 50 parts by weight of hydrazone (CTC-191, Takasago Inc.), 50 parts by weight of butadiene (T-405, Takasago Inc.), 100 parts by weight of polycarbonate (PCZ-400, Mitsubishi Gas Chemical Inc.), 1 part by weight of silicone oil (KF-340, Shin-Etsu Chemical Inc.), and 800 parts by weight of tetrahydrofuran are stirred together and dissolved. Thereafter, the half-finished photosensitive drum is dried in a drying furnace at 130° C. for 40 minutes to form the electric charge transport layer, and thus manufacture the photosensitive drum. The thickness of the electric charge transport layer is measured by positions of the photosensitive drum respectively spaced apart by 30 mm, 130 mm, 230 mm, and 330 mm from the upper portion thereof. The thickness at each of the positions is measured by using a thickness gauge (model number DCN-900, Check-Line Inc.) to measure 5 spots along a circumferential direction of the photosensitive drum, and a mean value thereof is determined as a thickness at the corresponding position.

Embodiment 2

A photosensitive drum is manufactured in the same method as that of the embodiment 1 except the 800 parts by weight of tetrahydrofuran is replaced by a mixed solvent in which 720 parts by weight of methylene chloride and 80 parts by weight of toluene are mixed when the photosensitive solution for the electric charge transport is prepared, and then the thickness of the electric charge transport layer is measured.

Embodiment 3

A photosensitive drum is manufactured in the same method as that of the embodiment 1 except the 800 parts by weight of tetrahydrofuran is replaced by a mixed solvent in which 400 parts by weight of methylene chloride and 400 parts by weight of 1,2-dichloroethane are mixed when the photosensitive solution for the electric charge transport is prepared, and then the thickness of the electric charge transport layer is measured.

Comparative Example 4

A photosensitive drum is manufactured in the same method as that of the embodiment 1 except the photosensitive solution is introduced up to 50 mm from the inner lower end in the hollow cylinder when the hollow cylinder is lowered to be immersed into the photosensitive solution, and then the thickness of the electric charge transport layer is measured.

Results measured on the basis of the above-described embodiments 1 to 3 and comparative examples 1 to 4 are summarized in table 1 below.

TABLE 1

| Measurement item | | Embodiment 1 | Embodiment 2 | Embodiment 3 | Comparative example 1 | Comparative example 2 | Comparative example 3 | Comparative example 4 |
|---|---|---|---|---|---|---|---|---|
| Evaporation speed of photosensitive solution | | 2.3 | 2.23 | 2.25 | 2.3 | 6.1 | 6.35 | 2.3 |
| Bubble discharge | | No | No | No | Occurrence | No | No | No |
| Coated inner surface | | No | No | No | No | No | No | Coating |
| Thickness of coated film | 30 mm | 24 μm | 24 μm | 25 μm | Coating defect generated due to bubble | 23 μm | 22 μm | 25 μm |
| | 130 mm | 25 μm | 24 μm | 25 μm | | 24 μm | 23 μm | 25 μm |
| | 230 mm | 25 μm | 25 μm | 25 μm | | 25 μm | 24 μm | 25 μm |
| | 330 mm | 25 μm | 25 μm | 24 μm | | 28 μm | 26 μm | 24 μm |
| | Deviation | 1 μm | 1 μm | 1 μm | | 5 μm | 4 μm | 1 μm |

Comparative Example 1

A photosensitive drum is manufactured in the same method as that of the embodiment 1 except, as a gripping condition of the air picker, only the distance between the lower end of the hollow cylinder and the lower end of the air picker is changed to 100 mm, and then the thickness of the electric charge transport layer is measured.

Comparative Example 2

A photosensitive drum is manufactured in the same method as that of the embodiment 1 except the 800 parts by weight of tetrahydrofuran is replaced by 800 parts by weight of toluene when the photosensitive solution for the electric charge transport is prepared, and then the thickness of the electric charge transport layer is measured.

Comparative Example 3

A photosensitive drum is manufactured in the same method as that of the embodiment 1 except the 800 parts by weight of tetrahydrofuran is replaced by a mixed solvent in which 400 parts by weight of 1,2-dichloroethane and 400 parts by weight of monochlorobenzene are mixed when the photosensitive solution for the electric charge transport is prepared, and then the thickness of the electric charge transport layer is measured.

As described above, to solve a gripping failure problem, as a state in which the movement of the hollow cylinder is restricted by the jig of the transfer tray in a process in which the fixed gripping mechanism is entered into the hollow cylinder is resolved, as a result, the center of the hollow cylinder may be freely moved to the position of the gripping mechanism to accomplish the purpose of gripping failure problem improvement.

Also, since the empty space formed by the lower surface of the gripping mechanism 120, the inner wall surface of the hollow cylinder 20, and the surface of the photosensitive solution 30 in the lower inner side of the hollow cylinder 20 in the gripped state needs to be minimized to reduce the manufacturing cost and improve quality of the formed layer, the above-described purpose is sufficiently accomplished by the lower end alignment process of the gripping mechanism 120 with respect to the hollow cylinder 20 according to the first, second, and third embodiments.

Also, the method for manufacturing the organic photosensitive drum according to the present invention may apply the photosensitive solution on only the outer surface of the hollow cylinder even in case of using the quick drying photosensitive solution containing the single or mixed solvent having the mean relative evaporation speed of 1.9 to 5 when the ether has the evaporation speed of 1 to decrease deviation of the coating amount of the photosensitive layer to minimize the runout tolerance problem after the gear or the bearing member is assembled, which may occur during the coating of the inner surface, thereby providing the photosensitive drum cylinder capable of acquiring further excellent image quality.

Meanwhile, in the organic photosensitive drum for electrophotography manufactured according to the present invention, the photosensitive material layer applied on the hollow cylinder may be formed by at least one layer, and in this case, at least one layer of the photosensitive material layers may be prepared by the photosensitive solution containing the single or mixed solvent having the relative evaporation speed of 1.9 to 5 with respect to ether, thereby being applied on only the outer surface of the hollow cylinder.

The invention claimed is:

1. A method for manufacturing an organic photosensitive drum for electrophotography, comprising:

inserting a gripping mechanism into a hollow cylinder when a lower end of the hollow cylinder is secured by a jig;

releasing the lower end of the hollow cylinder from the jig when the gripping mechanism is inserted into the hollow cylinder;

aligning a distal end of the gripping mechanism with a distal end of the lower end of the hollow cylinder when the lower end of the hollow cylinder is released from the jig and the jig is located outside the hollow cylinder;

gripping, by the gripping mechanism, the lower end of the hollow cylinder while the distal end of the gripping mechanism is aligned with the distal end of the lower end of the hollow cylinder when the lower end of the hollow cylinder is released from the jig and the jig is located outside the hollow cylinder; and dipping the hollow cylinder into a liquefied photosensitive material from the lower end of the hollow cylinder by the gripping mechanism gripping the lower end of the hollow cylinder.

2. The method of claim 1, further comprising:

intermediate-gripping the hollow cylinder by using the gripping mechanism when the gripping mechanism is inserted into the hollow cylinder and the lower end of the hollow cylinder is secured by the jig;

lifting the gripping mechanism to release the hollow cylinder from the jig; and releasing the hollow cylinder from the gripping mechanism in a state in which the distal end of the lower end of the hollow cylinder is supported, wherein the aligning the distal end of the gripping mechanism with the distal end of the lower end of the hollow cylinder is performed after the releasing the hollow cylinder from the gripping mechanism to grip the lower end of the hollow cylinder.

3. The method of claim 2, wherein in the releasing the hollow cylinder from the gripping mechanism, the distal end of the lower end of the hollow cylinder is supported on a plate type pallet or by using a separate plate type member.

4. The method of claim 1, wherein the gripping mechanism uses a contractible and expandable elastic member.

5. The method of claim 4, wherein the gripping mechanism is an air picker or an o-ring compression picker.

6. A method for manufacturing an organic photosensitive drum for electrophotography, comprising:

inserting a gripping mechanism into a hollow cylinder when a lower end of the hollow cylinder is secured by a jig;

releasing the lower end of the hollow cylinder from the jig when the gripping mechanism is inserted into the hollow cylinder;

aligning a distal end of the gripping mechanism with the lower end of the hollow cylinder when the lower end of the hollow cylinder is released from the jig;

gripping, by the gripping mechanism, the lower end of the hollow cylinder when the lower end of the hollow cylinder is released from the jig; and dipping the hollow cylinder into a liquefied photosensitive material from the lower end of the hollow cylinder by the gripping mechanism gripping the lower end of the hollow cylinder, wherein the releasing the lower end of the hollow cylinder from the jig includes:

placing a support plate, having a jig hole through which the jig passes, to support the lower end of the hollow cylinder; and lifting the support plate along the jig up to a position that the lower end of the hollow cylinder is released from the jig.

7. A method for manufacturing an organic photosensitive drum for electrophotography, comprising:

inserting a gripping mechanism into a hollow cylinder when a lower end of the hollow cylinder is secured by a jig;

releasing the lower end of the hollow cylinder from the jig when the gripping mechanism is inserted into the hollow cylinder;

aligning a distal end of the gripping mechanism with the lower end of the hollow cylinder when the lower end of the hollow cylinder is released from the jig;

gripping, by the gripping mechanism, the lower end of the hollow cylinder when the lower end of the hollow cylinder is released from the jig; and dipping the hollow cylinder into a liquefied photosensitive material from the lower end of the hollow cylinder by the gripping mechanism gripping the lower end of the hollow cylinder, wherein the releasing the lower end of the hollow cylinder from the jig includes:

placing a lifting member under a plate on which the jig is placed and having a through hole formed at a vicinity of the jig;

lifting the lifting member along the jig through the through hole to lift the hollow cylinder up to a position that the lower end of the hollow cylinder is released from the jig.

* * * * *